US010593278B2

(12) United States Patent
Lee et al.

(10) Patent No.: US 10,593,278 B2
(45) Date of Patent: Mar. 17, 2020

(54) DISPLAY DEVICE SUBPIXEL ACTIVATION PATTERNS

(71) Applicant: LG Display Co., Ltd., Seoul (KR)

(72) Inventors: Jongbeom Lee, Paju-si (KR); Beumsik Cho, Goyang-si (KR); Juyun Lee, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 135 days.

(21) Appl. No.: 15/822,906

(22) Filed: Nov. 27, 2017

(65) Prior Publication Data

US 2018/0151137 A1 May 31, 2018

(30) Foreign Application Priority Data

Nov. 25, 2016 (KR) ..... 10-2016-0158735

(51) Int. Cl.
*G09G 3/36* (2006.01)

(52) U.S. Cl.
CPC ..... *G09G 3/3659* (2013.01); *G09G 3/3607* (2013.01); *G09G 3/3614* (2013.01); *G09G 3/3677* (2013.01); *G09G 3/3688* (2013.01); *G09G 2300/0804* (2013.01); *G09G 2310/0291* (2013.01); *G09G 2310/0297* (2013.01); *G09G 2310/06* (2013.01); *G09G 2330/021* (2013.01)

(58) Field of Classification Search
CPC .. G09G 3/3685; G09G 3/3614; G09G 3/3688; G09G 3/3648; G09G 5/02; G09G 2310/0297; G09G 2310/0291; G09G 2300/0426; G09G 2330/021; G09G 2300/0452; G09G 2320/02; G02F 1/136286; G02F 1/1368
See application file for complete search history.

(56) References Cited

U.S. PATENT DOCUMENTS

2001/0050665 A1* 12/2001 Yeo ..... G09G 3/3688 345/87
2004/0179014 A1 9/2004 Nakano et al.
2007/0091050 A1 4/2007 Katayama et al.
2009/0179835 A1 7/2009 Ito
2013/0141320 A1 6/2013 Kim
2014/0198135 A1* 7/2014 Eom ..... G09G 3/3275 345/690
2015/0380435 A1 12/2015 Li et al.
2016/0078826 A1 3/2016 Yoo et al.
2016/0078836 A1 3/2016 Kim et al.
(Continued)

FOREIGN PATENT DOCUMENTS

CN 105590600 A 5/2016

*Primary Examiner* — Amr A Awad
*Assistant Examiner* — Maheen I Javed
(74) *Attorney, Agent, or Firm* — Seed Intellectual Property Law Group LLP

(57) ABSTRACT

A display device includes a data driver, a multiplexer, and a multiplexer controller. The data driver outputs a data voltage through output buffers. The multiplexer distributes each of the data voltages output by the output buffers to data lines in a time division manner in response to first to control signals. The multiplexer controller sequentially outputs control signals in a time division manner. Each control signal transitions to a gate ON voltage during a prior horizontal period and maintains the gate ON voltage for an intended horizontal period.

16 Claims, 7 Drawing Sheets

(56) References Cited

U.S. PATENT DOCUMENTS

| | | | | |
|---|---|---|---|---|
| 2016/0093260 | A1* | 3/2016 | Watsuda | G09G 3/3688 345/87 |
| 2016/0189657 | A1 | 6/2016 | Oh | |
| 2016/0322008 | A1 | 11/2016 | Sang et al. | |
| 2017/0154561 | A1* | 6/2017 | He | G02F 1/133512 |
| 2017/0205668 | A1 | 7/2017 | Kim et al. | |
| 2017/0213509 | A1 | 7/2017 | Kim et al. | |
| 2017/0358268 | A1* | 12/2017 | Nishio | G09G 3/20 |

* cited by examiner

DISPLAY DEVICE SUBPIXEL ACTIVATION PATTERNS

BACKGROUND

This application claims the priority benefit of Korean Patent Application No. 10-2016-0158735 filed on Nov. 25, 2016, which is hereby incorporated herein by reference for all purposes as if fully set forth herein.

TECHNICAL FIELD

The present disclosure relates to a display device which consumes less power.

DESCRIPTION OF THE RELATED ART

A flat panel display device includes a liquid crystal display (LCD), a field emission display (FED), a plasma display panel (PDP), an organic light emitting display device, and the like. In a flat panel display device, data lines and gate lines are disposed to intersect with each other, and regions in which a data line and the gate line intersect with each other is defined as a single subpixel. A plurality of subpixels is formed in a panel. In order to drive each subpixel, a video data signal desired to be displayed is supplied to the data lines and a gate pulse is sequentially supplied to the gate lines. The video data signal is supplied to subpixels of a display line to which the gate pulse is supplied, and as all the data lines are sequentially scanned by the gate pulse, video data is displayed.

The video data signal provided to the data lines is generated by a data driver, and the data driver outputs a data voltage through a source channel connected to the data line. In order to reduce the number of source channels, a structure in which a plurality of data lines are connected to one source channel and a data voltage output to the source channel is supplied to the data lines in a time division manner using a multiplexer is used. The multiplexer includes switches selectively connecting the source channel and the plurality of data lines, and the switches are turned on in response to a control signal to connect the source channel and one data line.

As resolution of a display panel is increased, a time period during which a data voltage is supplied to one horizontal line is shortened, and accordingly, an output period of control signals for controlling switches is also shortened. Specifically, a period during which control signals from the multiplexer are reversed from a gate ON voltage to a gate OFF voltage or from a gate OFF voltage to a gate ON voltage is shortened. When reversing of a voltage level of control signals (e.g., transition) very frequently over a short period of time, a circuit section generating the control signal consumes a large amount of power.

Also, as subpixel density is increased, a period during which control signals controlling the multiplexer maintain the gate ON voltage is so short that a data charge rate is shortened.

BRIEF SUMMARY

According to an aspect of the present disclosure, a display device may include a display panel, a data driver, a multiplexer, and a multiplexer controller. N number of color subpixels may be disposed on the display panel (N is an integer of 2 or greater). The data driver may output data voltages to be supplied to the N number of color subpixels, through output buffers. The multiplexer may distribute each of the data voltages output by the output buffers to N number of data lines in a time division manner in response to first to N control signals. The multiplexer controller may sequentially output a first control signal to an N number control signal during a first horizontal period, and sequentially output the N number control signal to the first control signal during a second horizontal period. One of I number of control signals maintaining a gate ON voltage at a time when a first horizontal period expires may maintain the gate ON voltage for a predetermined period of time after a second horizontal period starts (I is an integer equal to or less than N).

BRIEF DESCRIPTION OF THE SEVERAL VIEWS OF THE DRAWINGS

The above and other aspects, features, and advantages of the present disclosure will be more clearly understood from the following detailed description taken in conjunction with the accompanying drawings, in which.

DETAILED DESCRIPTION

Figure 1:
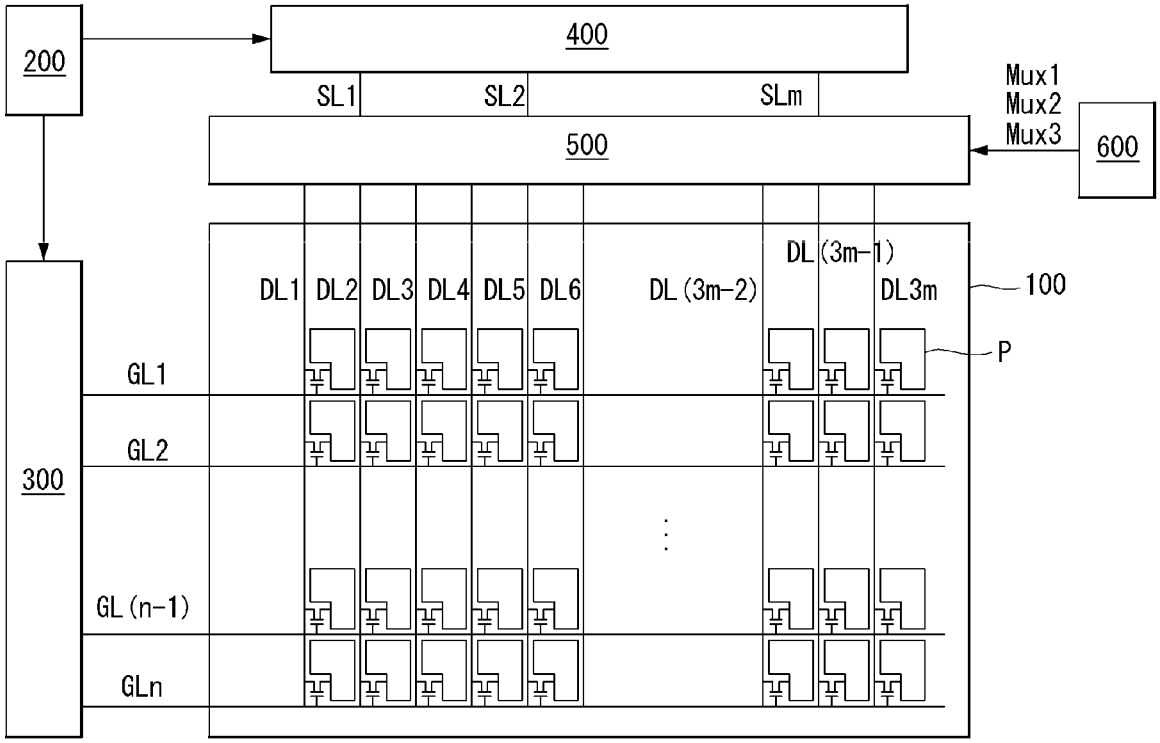
FIG. 1 is a view illustrating a display device according to an embodiment of the present disclosure.

Hereinafter, embodiments of the present disclosure will be described in detail with reference to the accompanying drawings. Like reference numerals refer to like elements throughout. In the following description, certain specific details are set forth in order to provide a thorough understanding of various embodiments of the disclosure. However, one skilled in the art will understand that the disclosure may be practiced without these specific details. In other instances, well known structures associated with electronic components and fabrication techniques have not been described in detail to avoid unnecessarily obscuring the descriptions of the embodiments of the present disclosure.

Unless the context requires otherwise, throughout the specification and claims that follow, the word "comprise" and variations thereof, such as "comprises" and "comprising," are to be construed in an open, inclusive sense; that is, as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

As used in the specification and the appended claims, the use of "correspond," "corresponds," and "corresponding" is intended to describe a ratio of or a similarity between referenced objects. The use of "correspond" or one of its forms should not be construed to mean the exact shape or size.

The present disclosure is directed to a display device with a set control signal timing. The display device includes color subpixels that are driven according to a set of control signals from a multiplexer. The multiplexer can provide various patterns of control signals, and in one embodiment provides gate control signals in a first sequence and then in a second sequence opposite the first sequence. This may result in reduced switching time and power as no gate signal switching is done at the beginning and end of the sequence.

In a gate driver of the present disclosure, switches may be implemented as transistors having a structure of n-type or p-type metal oxide semiconductor field effect transistors (MOSFETs). In the embodiments described hereinafter, an n-type transistor will be described, but the present disclosure is not limited thereto. For example, other types of transistors (e.g., P-type MOSFETs, BJTs, and TFETs) or any other switches may also be used. In the present disclosure, outputting control signals refers to a state in which the corresponding control signals are in a gate ON voltage state. That is, gate ON voltage of the switches as n type transistors correspond to a high potential voltage and outputting or applying control signals refers to a state in which corresponding control signals are in a high potential voltage state.

Figure 2:
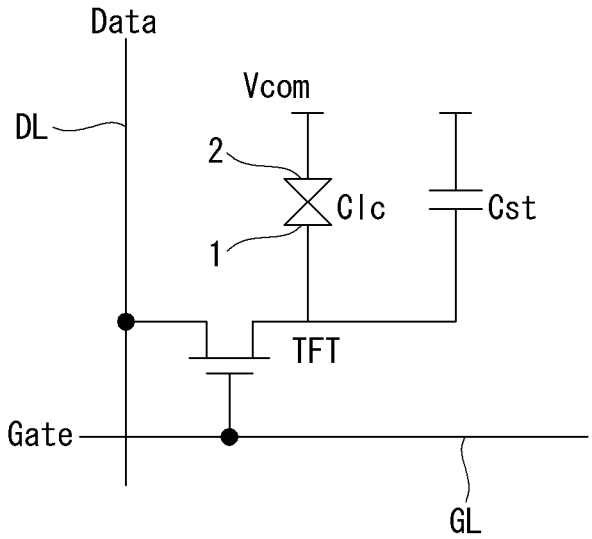
FIG. 2 is a view illustrating an example of a subpixel illustrated in FIG. 1.

FIG. 1 is a view illustrating a display device according to an embodiment of the present disclosure, and FIG. 2 is a view illustrating an example of a subpixel illustrated in FIG. 1.

Referring to FIGS. 1 and 2, the display device of the present disclosure includes a display panel 100, a timing controller 200, a gate driver 300, a data driver 400, a multiplexer 500, and a multiplexer controller 600.

The display panel 100, including a subpixel array in which subpixels are disposed in a matrix form, displays input image data. As illustrated in FIG. 2, the subpixel array includes a thin film transistor (TFT) array formed on a lower substrate, a color filter array formed on an upper substrate, and liquid crystal cells Clc. The TFT array includes a data line DL and a gate line GL crossing the data line DL, a TFT formed at a crossing between the data line DL and the gate line GL, a subpixel electrode 1 connected to the TFT, a storage capacitor Cst, and the like. The color filter array includes a black matrix and a color filter. A common electrode 2 may be formed on the lower substrate or upper substrate. Liquid crystal cells Clc are driven by an electric field between the subpixel electrode 1 to which a data voltage is supplied and the common electrode 2 to which a common voltage Vcom is supplied.

The timing controller 200 may receive digital video data RGB from an external host and receives timing signals such as a vertical synchronization signal Vsync, a horizontal synchronization signal Hsync, a data enable signal DE, a main clock CLK, and the like. The timing controller 200 transmits the digital video signal RGB to the data driver 400. The timing controller 200 generates a source timing control signal for controlling an operation timing of the data driver 400 using the timing signals Vsync, Hsync, DE, and CLK and gate timing control signals ST, GCLK, and MCLK for controlling an operation timing of a level shifter and a shift register of the gate driver 300.

The gate driver 300 outputs a gate pulse Gout using a gate timing control signal. The gate timing control signal includes a gate start pulse (GSP), a gate shift clock (GSC), and a gate output enable (GOE). The gate start pulse (GSP) indicates a starting line for the gate driver 300 to output a first gate pulse Gout. The gate shift clock (GSC) is a clock for shifting the gate start pulse (GSP). The gate output enable (GOE) sets an output period of the gate pulse Gout. The gate driver 300 may be implemented in the form of a gate-in-panel (GIP) including a combination of TFTs on the display panel 100.

The data driver 400 converts image data provided from the timing controller 200 into a data voltage.

Figure 3:
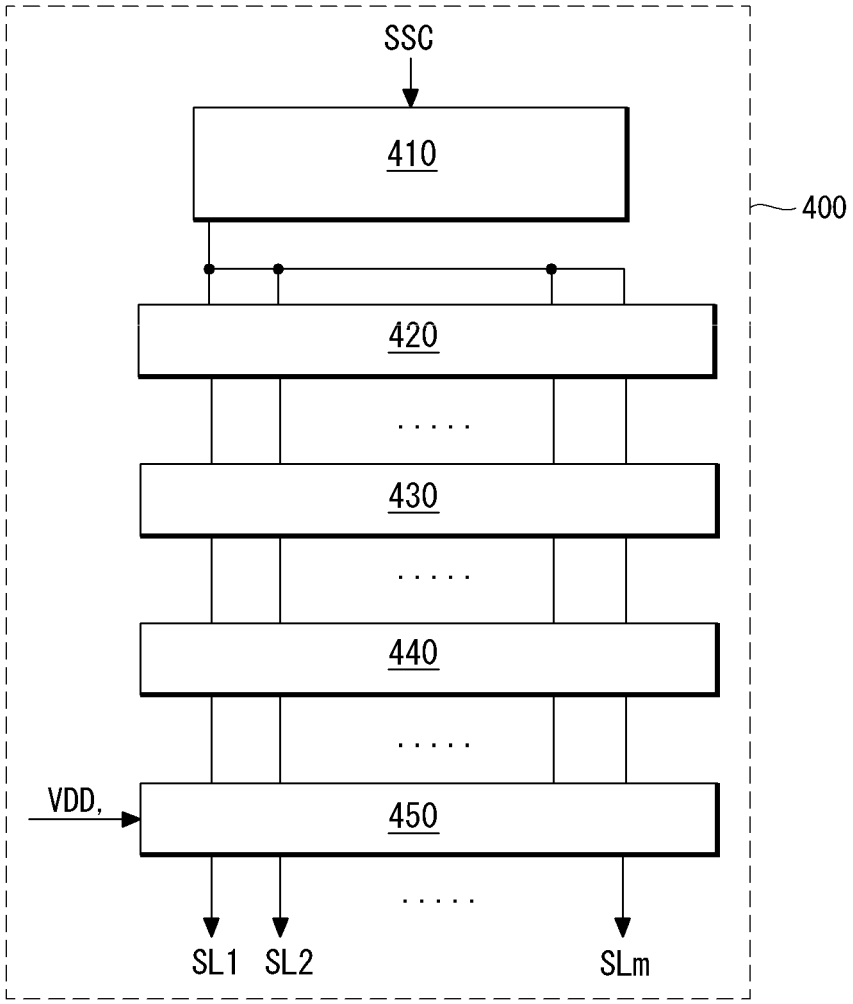
FIG. 3 is a view illustrating an example of a data driver.

FIG. 3 is a view illustrating a configuration of a data driver. Referring to FIG. 3, the data driver 400 includes a register unit 410, a first latch 420, a second latch 430, a digital-to-analog converter (DAC) 440, and an output unit 450. The register unit 410 samples RGB digital video data bits of the input image using data control signals SSC and SSP provided from the timing controller 200, and provides the sampled digital video data bits to the first latch 420. The first latch 420 samples and latches the digital video data bits according to clocks sequentially provided from the register unit 410, and simultaneously outputs the latched data. The second latch 430 latches data provided from the first latch 420 and simultaneously outputs latched data in response to a source output enable signal SOE. The DAC 440 converts video data input from the second latch unit 430 into a gamma compensation voltage GMA to generate an analog video data voltage. The output unit 450 provides an analog type data voltage ADATA output from the DAC 440 to the data lines DL during a low logical period of the source output enable signal SOE. The output unit 450 may be implemented as an output buffer outputting a data voltage using a low potential voltage GND and a voltage received through a high potential input terminal, as driving voltages.

The multiplexer 500 distributes data voltages output from output buffers to the plurality of data lines DL in a time division manner. In FIG. 1, an embodiment is depicted in which 3m number of data lines DL are connected to each output buffer. However, the number of data lines connected to the output buffers is not limited thereto. In some embodiments, the multiplexer is any switching device capable of selecting coupling an input to one or more of a plurality of outputs. In one embodiment the switching device is a switch having an input contact, an output contact, and a gate or state controller.

Figure 4:
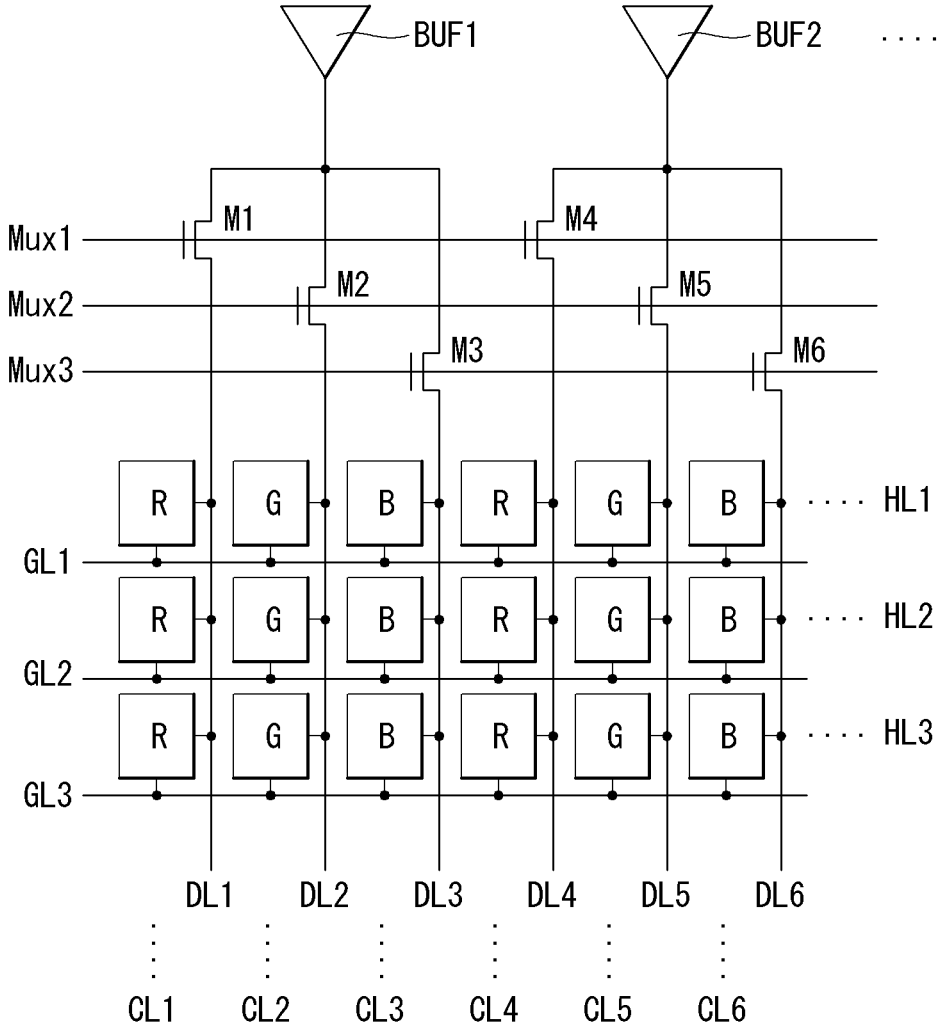
FIG. 4 is a view illustrating a structure of multiplexers and subpixel arrays according to a first embodiment of the present disclosure.
Figure 5:
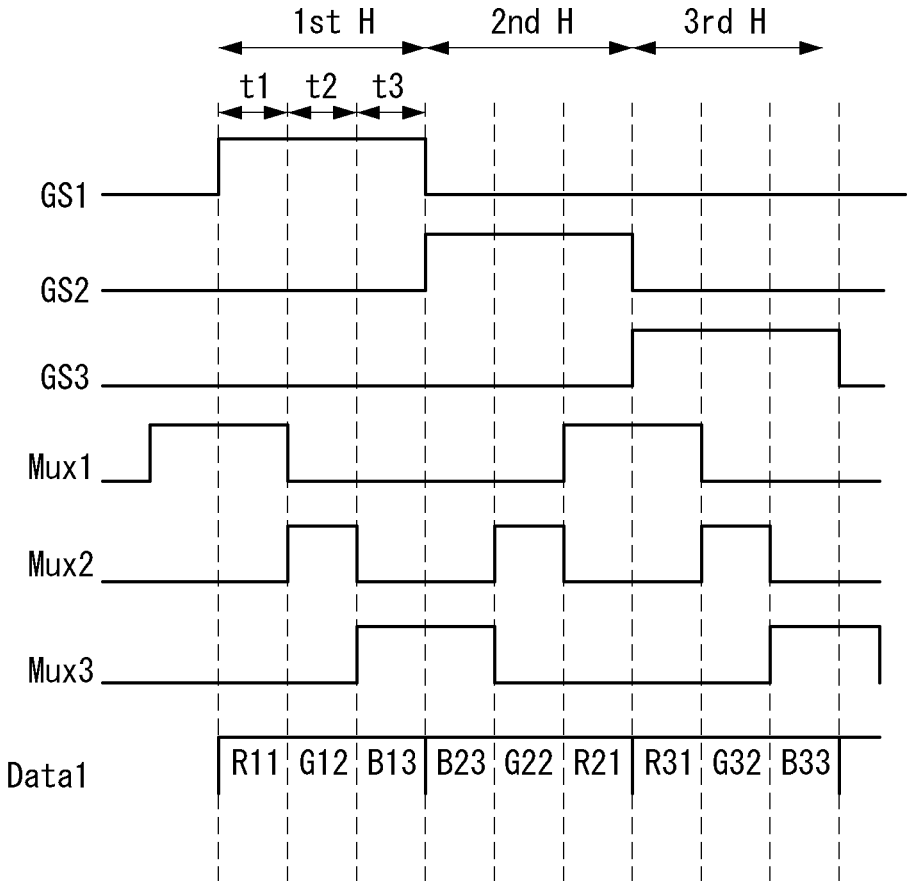
FIG. 5 is a view illustrating a timing of control signals according to the first embodiment of the present disclosure.

FIG. 4 is a view illustrating a structure of multiplexers and subpixel arrays according to a first embodiment of the present disclosure, and FIG. 5 is a view illustrating a timing of control signals and a gate pulse according to the first embodiment of the present disclosure.

Referring to FIGS. 4 and 5, the display panel 100 includes red subpixels R, green subpixels G, and blue subpixels B disposed in parallel in each pixel line HL. The subpixels disposed in each pixel line receive a gate pulse GS1 through the gate line GL. For example, subpixels P disposed in a first pixel line HL1 receive a first gate pulse GS1 through a first gate lines GL1. Also, subpixels P disposed in a second pixel line HL2 receive a second gate pulse GS2 through a second gate line GL2, and subpixels P disposed in a third pixel line HL3 receive a third gate pulse GS3 through a third gate line GL3.

In some embodiments, the different color subpixels R, G, and B are disposed in a repeating pattern. For example, in the last sequence, the red subpixels R are disposed in a (3m−2)th column line (CL[3m−2]), the green pixels G are disposed in a (3m−1)th column line (CL [3m−1]), and the blue subpixels B are disposed in a 3mth column line (CL3m). In this example, red subpixels R are disposed in a first column line CL1 and a fourth column line CL4. Green pixels G are disposed in a second column line CL2 and a fifth column line CL5. Also, blue subpixels B are disposed in a third column line CL3 and a sixth column line CL6.

The data driver 400 outputs a data voltage to three subpixels positioned in one pixel line HL during every horizontal period H. For example, a first output buffer BUF1 of the data driver 400 sequentially outputs a data voltage applied to R11, G12, and G13 during a first scan period t1 of the first horizontal period $1^{st}$ H. In this embodiment, R (or B or B)xy represents a color and a position of a subpixel. That is, Rab refers to a red subpixel positioned in a horizontal line a and a column line b. Thus, R11 refers to a red subpixel positioned in a first column line CL1 in the first pixel line HL1. Also, in FIG. 5, Data1 illustrates subpixels to which a data voltage output by the first output buffer BUF1 is applied. Also, the first horizontal period 1H may be defined as a period during which a data voltage is supplied to the subpixels P disposed in one pixel line HL. The data driver 400 supplies the data voltage to three subpixels during the first horizontal period 1H in a time division manner. Each of the first to third scan periods t1 to t3 of each horizontal period is defined as a period during which a data voltage applied to one subpixel P is output.

The multiplexer 500 distributes data voltages, which are output by the output buffers BUF, to a plurality of data lines. The multiplexer 500 according to the first embodiment distributes a data voltage output by the first output buffer BUF1 to first to third data lines DL1 to DL3 in a time division manner. To this end, the multiplexer 500 includes first to third switches M1, M2, and M3. The first switch M1 is turned on in response to a first control signal Mux1 to connect the first output buffer BUF1 and the first data line DL1. The second switch M2 is turned on in response to a second control signal Mux2 to connect the first output buffer and the second data line DL2, and the third switch M3 is turned on in response to a third control signal Mux3 to connect the first output buffer BUF1 and the third data line DL3.

The multiplexer (switch) controller 600 outputs the first to third control signals in a time division manner during one horizontal period H. The multiplexer controller 600 may sequentially output the first, second, and third control signals Mux1, Mux2, and Mux3 or sequentially output the third, second, and first control signals Mux3, Mux2, and Mux1, during one horizontal period. For example, the multiplexer controller 600 sequentially outputs the first to third control signals Mux1 to Mux3 during the first horizontal period $1^{st}$ H and sequentially outputs the third to first control signals Mux3 to Mux1 during a second horizontal period $2^{nd}$ H.

The first to third control signals Mux1 to Mux3 are sequentially output during each horizontal period H in which the gate pulse GS maintains a gate ON voltage. For example, during the first horizontal period 1H, the first gate pulse GS1 maintains the gate ON voltage and the first to third control signals Mux1 to Mux3 are sequentially output.

As a result, the subpixel R11 is charged during the first scan period t1 of the first horizontal period $1^{st}$ H, the subpixel G12 is charged during the second scan period t2 of the first horizontal period $1^{st}$ H, and the subpixel B13 is charged during the third scan period t3 of the first horizontal period $1^{st}$ H.

Also, the subpixel B23 is charged during a first scan period t1 of a second horizontal period $2^{nd}$ H, the subpixel G22 is charged during a second scan period t2 of the second horizontal period $2^{nd}$ H, and the subpixel R21 is charged during a third scan period t3 of the second horizontal period $2^{nd}$ H.

In this manner, in the first embodiment, the third control signal Mux3 is output during the final period of the first horizontal period $1^{st}$ H and the first period of the second horizontal period $2^{nd}$ H. That is, the number of times the third control signal Mux3 is reversed to a gate ON voltage and the number of times the third control signal Mux3 is reversed to a gate OFF voltage from the first horizontal period $1^{st}$ H to the second horizontal period $2^{nd}$ H are one time, respectively. Similarly, the number of times the first control signal Mux1 is reversed to a gate ON voltage and the number of times the first control signal Mux1 is reversed to a gate OFF voltage from the second horizontal period $2^{nd}$ H to the third horizontal period $3^{rd}$ H are one time, respectively.

As a result, overall transition number of the control signals Mux1 to Mux3 output by the multiplexer controller 600 is reduced, and thus, power consumption of the multiplexer controller 600 is reduced.

Figure 6:
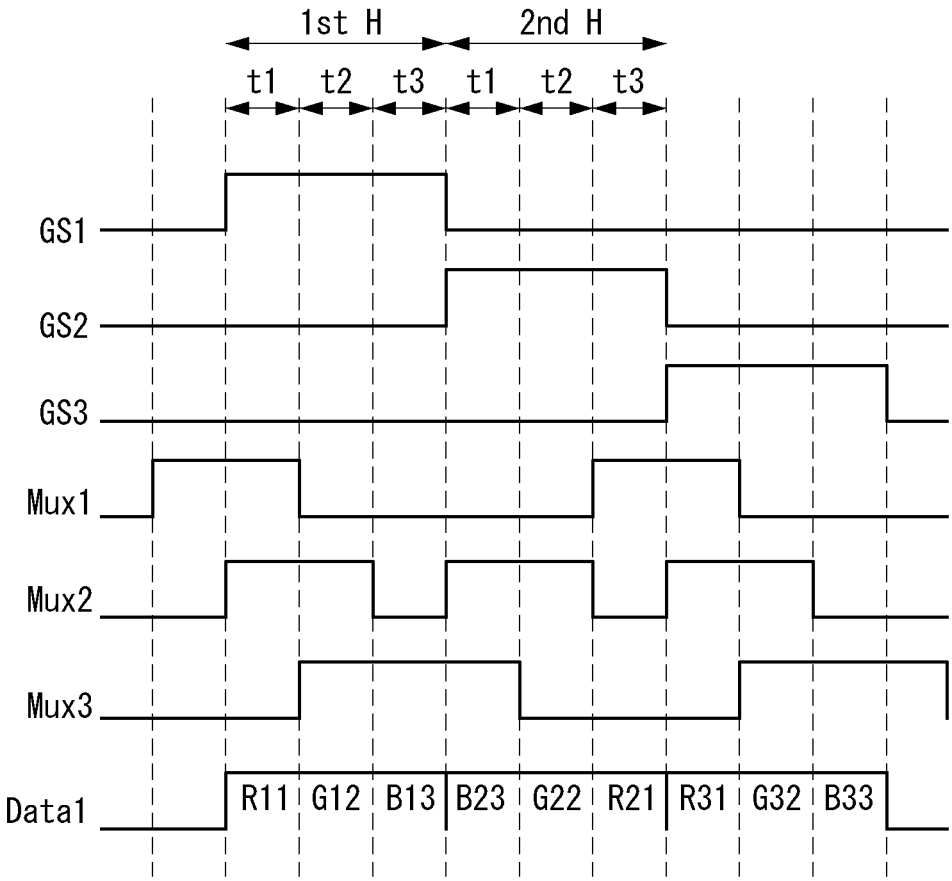
FIG. 6 is a view illustrating a timing of control signals according to a second embodiment of the present disclosure.

FIG. 6 is a view illustrating a timing of control signals according to a second embodiment of the present disclosure. In FIG. 6, a timing diagram for driving the multiplexers and the pixel array illustrated in FIG. 4 is illustrated. Detailed descriptions of the same components of the embodiment illustrated in FIG. 6 as those illustrated in FIG. 5 will be omitted.

Referring to FIG. 6, the second control signal Mux2 is output before the second scan period t2 starts, and the third control signal Mux3 is output before the third scan period t3 starts. For example, the second control signal Mux2 is output when the first scan period t1 starts, and the third control signal Mux3 is output when the second scan period t2 starts. As a result, the control signals Mux1 to Mux3 output to be adjacent to each other overlap in at least portions thereof. For example, the first control signal Mux1 and the second control signal Mux2 partially overlap, and the second control signal Mux2 and the third control signal Mux3 partially overlap.

In this manner, since the control signals Mux1 to Mux3 according to the second embodiment extend in an output period maintained by the gate ON voltage, a sufficient charge period of the data voltage may be secured.

Figure 7:
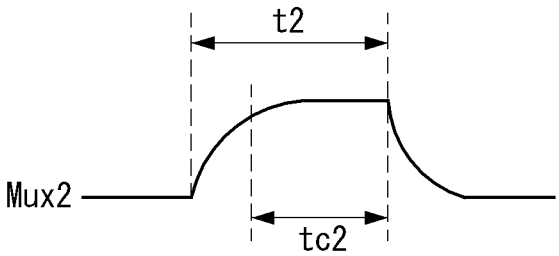
FIG. 7 is a view illustrating a data charge time reduced due to a multiplexer control signal delay phenomenon.

In the first embodiment, a period for charging data may be shortened due to delay of the control signals Mux1 to Mux3. For example, as illustrated in FIG. 7, when the second control signal Mux2 output during the second scan period t2 of the first horizontal period $1^{st}$ H is delayed by an RC delay, a period during which data can be charged is "tc2".

In contrast, since the second control signal Mux2 according to the second embodiment is output before the second scan period t2, although it is delayed by the RC delay, the second control signal Mux2 may have the gate ON voltage at a time when the second scan period t2 starts. As a result, the second control signal Mux2 according to the second embodiment may charge the data voltage during the second scan period t2. In this manner, the control signals Mux1 to Mux3 according to the second embedment may sufficiently secure a turn-on period of the switches M1 to M6 to prevent a reduction in a charge time of the data voltage.

Figure 8:
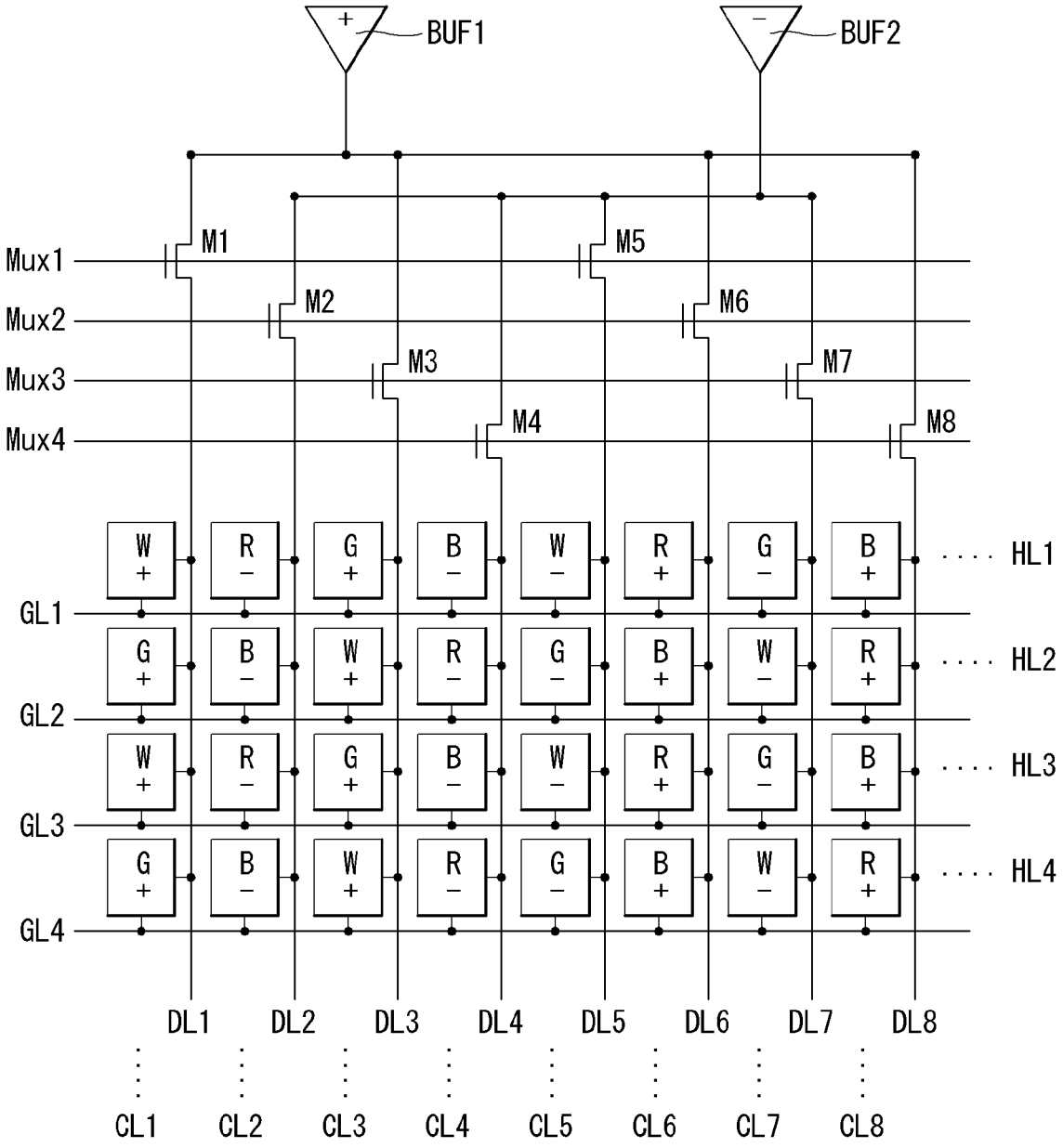
FIG. 8 is a view illustrating a structure of multiplexers and subpixel arrays according to the second embodiment of the present disclosure.
Figure 9:
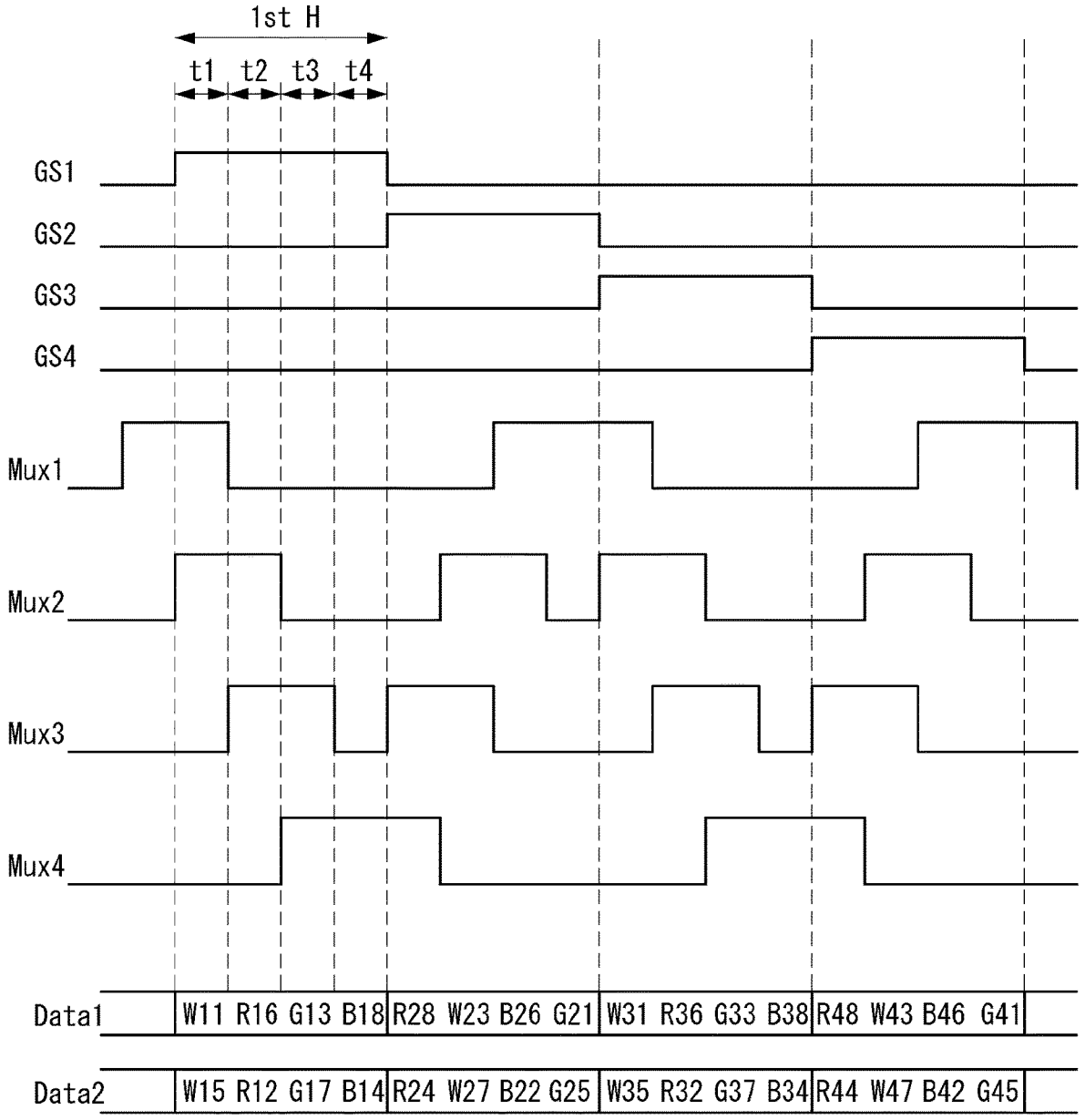
FIG. 9 is a view illustrating a timing of control signals according to a third embodiment of the present disclosure.

FIG. 8 is a view illustrating a structure of pixel arrays and multiplexers according to the second embodiment of the present disclosure, and FIG. 9 is a timing diagram of control signals and gate pulses according to a third embodiment of the present disclosure. Detailed descriptions of the same components of the embodiment illustrated in FIG. 8 as those of the embodiment described above will be omitted.

Referring to FIGS. 8 and 9, subpixels include a white subpixel W, a red subpixel R, a green subpixel G, and a blue subpixel B.

In odd-numbered pixel lines HL1 and HL3, W, R, G, and B subpixels are sequentially disposed, and in even-numbered pixel lines HL2 and HL4, G, B, W, and R subpixels are sequentially disposed. Thus, the W, R, G, and B subpixels disposed in parallel in each pixel line may form a unit pixel. Alternately, W, R, G, and B subpixels disposed in 2×2 unit may form a unit pixel. In image rendering of the display panel, one unit pixel may be used as a reference or two adjacent subpixels may be used as a reference.

The multiplexer 500 distributes data voltages, which are output by the output buffers BUFs, to a plurality of data lines. The multiplexer 500 distributes a positive (+) polarity data voltage, which is output by the first output buffer BUF1, to a first data line DL1, a third data line DL3, a sixth data line DL6, and an eight data line DL8 in a time division manner. Also, the multiplexer 500 distributes a negative (−) polarity data voltage, which is output by the second output buffer BUF2, to a second data line DL2, a fourth data line DL4, a fifth data line DL5, and a seventh data line DL7 in a time division manner. To this end, the multiplexer 500 includes first to eighth switches M1 to M8.

The first switch M1 is turned on in response to the first control signal Mux1 to connect the first output buffer BUF1 to the first data line DL1. The third switch M3 is turned on in response to the third control signal Mux3 to connect the first output buffer BUF1 to the third data line DL3. The sixth switch M6 is turned on in response to the second control signal Mux2 to connect the first output buffer BUF1 to the sixth data line DL6. The eighth switch M8 is turned on in response to the fourth control signal Mux4 to connect the first output buffer BUF1 to the eighth data line DL8.

The second switch M2 is turned on in response to the second control signal Mux2 to connect the second output buffer BUF2 to the second data line DL2. The fourth switch M4 is turned on in response to the fourth control signal Mux4 to connect the second output buffer BUF2 to the fourth data line DL4. The fifth switch M5 is turned on in response to the first control signal Mux1 to connect the second output buffer BUF2 to the fifth data line DL5. The seventh switch M7 is turned on in response to the third control signal Mux3 to connect the second output buffer BUF2 to the seventh data line DL7.

The multiplexer controller 600 outputs the first to fourth control signals Mux1 to Mux4 in a time division manner during one horizontal period 1H. The multiplexer controller 600 may sequentially output the first control signal Mux1 to the fourth control signal Mux4 or sequentially output the fourth control signal Mux4 to the first control signal Mux1 during one horizontal period. For example, the multiplexer controller 600 may sequentially output the first control signal Mux1 to the fourth control signal Mux4 during a first horizontal period $1^{st}$ H and sequentially output the fourth control signal Mux4 to the first control signal Mux1 during a second horizontal period $2^{nd}$ H.

Within one horizontal period 1H, the first control signal Mux1 to the fourth control signal Mux4 are output during one scan period 1t. Within each horizontal period H, each of first to fourth scan periods t1 to t4 is defined as a period during which a data voltage applied to one subpixel P is output.

The data driver 400 outputs data voltages having the opposite polarities through mutually adjacent output buffers. For example, the data driver 400 may output a positive (+) polarity data voltage to the output buffer BUF1 and output a negative (−) polarity data voltage to the second output buffer BUF2.

The data driver 400 outputs a data voltage to one pixel line HL during each horizontal period H. In FIG. 9, Data1 represents subpixels to which a data voltage output by the first output buffer BUF1 is applied, and Data2 represents subpixels to which a data voltage output by the second output buffer BUF2 is applied. That is, the first output buffer BUF1 of the data driver 400 sequentially outputs a data voltage supplied to subpixels positioned in a first column line CL1, a sixth column line CL6, a third column line CL3, and an eighth column line CL8 during each horizontal period H. The second output buffer BUF2 sequentially outputs a data voltage supplied to subpixels positioned in a fifth column line CL5, a second column line CL2, a seventh column line CL7, and a fourth column line CL4 during each horizontal period H.

As a result, a subpixel W11 and a subpixel W15 are charged during a first scan period t1 of the first horizontal period $1^{st}$ H. A subpixel R16 and a subpixel R12 are charted during a second scan period t2 of the first horizontal period $1^{st}$ H. A subpixel G13 and a subpixel G17 are charged during a third scan period t3 of the first horizontal period $1^{st}$ H. A subpixel B18 and a subpixel B14 are charged during a fourth scan period t4 of the first horizontal period $1^{st}$ H.

Also, before a data voltage is applied to the data line DL, the control signals Mux are output as a gate ON voltage. For example, during the second scan period t2, the data driver 400 outputs a data voltage applied to the subpixel R16 and the subpixel R12. The subpixel R16 receives the data voltage through the sixth data line DL6, and the sixth data line DL6 is connected to the first output buffer BUF1 through the sixth switch M6. The second control signal Mux2 controlling the sixth switch M6 is output as a gate ON voltage before the second scan period t2. Thus, although the second control signal Mux2 is delayed, the sixth switch M6 may be turned on at a timing when the second scan period t2 starts. As a result, a data charge period may be prevented from being shortened.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A display device comprising:

a data driver outputting a data voltage through output buffers;

a multiplexer distributing data voltages, which are respectively output by the output buffers, to n number of data lines, in response to first to n number of control signals, n being an integer of 3 or greater; and a multiplexer controller outputting the first to n number of control signals in a time division manner, wherein a first one of the n number of control signals transitions to a gate ON voltage during a first horizontal period and maintains the gate ON voltage for a predetermined period of time after a second horizontal period starts, wherein each of the first and second horizontal periods includes n number of scan periods, and the data driver outputs a data voltage to be supplied to one subpixel during one of the n number of scan periods, wherein the multiplexer includes n number of switches which are configured to turn on in response to a respective one of the n number of control signals, the first one of the n number of control signals maintaining the gate ON voltage during a last scan period of the first horizontal period and a first scan period of the second horizontal period, and wherein the multiplexer controller sequentially outputs the n number of control signals during the first horizontal period, and sequentially output the n number of control signals during the second horizontal period in a reverse order to the first horizontal period, wherein a second one of the n number of control signals overlaps with the first one of the n number of control signals, and the second one of the n number of control signals overlaps with the third one of the n number of control signals.

2. The display device of claim 1, wherein the multiplexer is configured to start outputting the first one of the n number of control signals as a gate ON voltage during the second to last scan period of the first horizontal period.

3. The display device of claim 1, wherein the output buffers of the data driver include a first output buffer configured to output a positive polarity data voltage and a second output buffer configured to output a negative polarity data voltage, the multiplexer includes a first switch, a third switch, a sixth switch, and an eighth switch configured to distribute a data voltage from the first output buffer to a first data line, a third data line, a sixth data line, and an eighth data line of the n number of data lines in a time division manner, respectively, and a second switch, a fourth switch, a fifth switch, and a seventh switch configured to distribute a data voltage from the second output buffer to a second data line, a fourth data line, a fifth data line, and a seventh data line of then number of data lines in a time division manner, respectively, and the multiplexer controller configured to output:

a first control signal controlling the first and fifth switch;

a second control signal controlling the second and sixth switch;

a third control signal controlling the third and seventh switch; and a fourth control signal controlling the fourth and eighth switch.

4. The display device of claim 3, wherein the multiplexer configured to sequentially output the n number of control signals during the first horizontal period in a first order, the multiplexer configured to sequentially output the n number of control signals during the second horizontal period in a second order opposite the first order, and at least portions of each one of the n number of control signals overlap.

5. A method, comprising:

outputting, by a data driver, data voltages through output buffers;

sequentially outputting, by a multiplexer controller, n number of control signals in a time division manner in a first horizontal period;

sequentially outputting, by the multiplexer controller, the n number of control signals during a second horizontal period in a reverse order to the first horizontal period;

receiving a first control signal of the n number of control signals at a switching device, the first control signal having a first portion and a second portion;

receiving a second control signal of the n number of control signals at the switching device, the second control signal having a first portion and a second portion;

receiving a third control signal of the n number of control signals at the switching device, the third control signal having a first portion and a second portion;

illuminating a first plurality of subpixels on a display panel, the first plurality of subpixels arranged in a first position order according to color, the illuminating including:

activating a first subpixel of the first plurality of subpixels for a first scan period of the first horizontal period based on the first portion of the first control signal;

activating a second subpixel of the first plurality of subpixels for a second scan period of the first horizontal period based on the first portion of the second control signal, the second scan period starting after the first scan period; and activating a third subpixel of the first plurality of subpixels for a third scan period of the first horizontal period based on the first portion of the third control signal, the third scan period starting after the second scan period; and illuminating a second plurality of subpixels on the display panel, the second plurality of subpixels arranged in a second position order according to color, the illuminating including:

activating a fourth subpixel of the second plurality of subpixels for a fourth scan period of the second horizontal period based on the second portion of the third control signal, the fourth scan period starting after the third scan period;

activating a fifth subpixel of the second plurality of subpixels for a fifth scan period of the second horizontal period based on the second portion of the second control signal, the fifth scan period starting after the fourth scan period; and activating a sixth subpixel of the second plurality of subpixels for a sixth scan period of the second horizontal period based on the second portion of the first control signal, the sixth scan period starting after the fifth scan period, wherein the multiplexer includes n number of switches which are configured to turn on in response to a respective one of the first, second, and third control signals, the third control signal maintaining a gate ON voltage during the third scan period of the first horizontal period and the fourth scan period of the second horizontal period, and the second control signal overlaps with the first control signal and the third control signal.

6. The method of claim 5, wherein the first position order is the same as the second position order.

7. The method of claim 5, further comprising:

receiving a third portion of the third control signal during the second scan period; and receiving a third portion of the second control signal during the first scan period.

8. The method of claim 5, wherein the first subpixel is a first color, the second subpixel is a second color, the sixth subpixel is the first color, and the fifth subpixel is the second color.

9. The method of claim 5, wherein the first and sixth subpixels are a first color, the second and fifth subpixels are a second color, and the third and fourth subpixels are a third color.

10. The method of claim 5, wherein activating the third subpixel includes activating a first switch of the switching device, and wherein activating the fourth subpixel includes activating the first switch.

11. The method of claim 5, further comprising:

receiving a third portion of the first control signal during a scan period preceding the first scan period;

receiving a third portion of the second control signal during the first scan period; and receiving a third portion of the third control signal during the second scan period.

12. The method of claim 5, further comprising:

receiving a fourth control signal at the switching device, the fourth control signal having a first portion and a second portion, the illuminating the first plurality of subpixels including activating a seventh subpixel of the first plurality of subpixels for a seventh scan period of the first horizontal period based on the first portion of the fourth control signal, the seventh scan period before the first scan period, and the illuminating the second plurality of subpixels including activating an eighth subpixel of the second plurality of subpixels for an eighth scan period of the second horizontal period based on the second portion of the fourth control signal, the eighth scan period starting after the sixth scan period.

13. The method of claim 12, wherein activating the third subpixel includes activating a first switch of the switching device, and wherein activating the fourth subpixel includes activating the first switch.

14. The method of claim 12, wherein the first position order is different from the second position order.

15. The method of claim 12, further comprising:

receiving a third portion of the first control signal during the seventh scan period;

receiving a third portion of the second control signal during the first scan period;

receiving a third portion of the third control signal during the second scan period; and receiving a third portion of the fourth control signal during the sixth scan period.

16. The device of claim 12, wherein the fifth and seventh subpixels are white, the first and fourth subpixels are red, the second and eighth subpixels are green, and the third and sixth subpixels are blue.

* * * * *